US010064472B2

(12) United States Patent
Campbell et al.

(10) Patent No.: US 10,064,472 B2
(45) Date of Patent: Sep. 4, 2018

(54) WATER-BASED ANTIPERSPIRANT AND AEROSOL DISPENSER THEREFOR

(75) Inventors: Stuart John Campbell, Wilnis (NL); Andrew Iwan De Beer, Zoetermeer (NL)

(73) Assignee: Colgate-Palmolive Company, New York, NY (US)

( * ) Notice: Subject to any disclaimer, the term of this patent is extended or adjusted under 35 U.S.C. 154(b) by 1963 days.

(21) Appl. No.: 11/917,486

(22) PCT Filed: Jun. 16, 2005

(86) PCT No.: PCT/EP2005/006467
§ 371 (c)(1),
(2), (4) Date: Dec. 19, 2007

(87) PCT Pub. No.: WO2006/133725
PCT Pub. Date: Dec. 21, 2006

(65) Prior Publication Data
US 2008/0111005 A1 May 15, 2008

(51) Int. Cl.
*A62C 31/02* (2006.01)
*B05B 1/00* (2006.01)
(Continued)

(52) U.S. Cl.
CPC ..... *A45D 34/00* (2013.01); *B65D 83/206* (2013.01)

(58) Field of Classification Search
CPC .... B05B 1/00; B05B 1/02; B05B 1/34; B05B 5/025; B05B 7/02; B05B 7/2478;
(Continued)

(56) References Cited

U.S. PATENT DOCUMENTS 3,189,232 A * 6/1965 Joffe ..... 222/402.13
3,544,258 A * 12/1970 Presant et al. ..... 222/192
(Continued)

FOREIGN PATENT DOCUMENTS

DE 20 2004 011 650 U1 7/2004
WO WO 01/52805 7/2001

OTHER PUBLICATIONS

International Search Report dated Feb. 7, 2006.

*Primary Examiner* — Justin Jonaitis

(57) ABSTRACT

An antiperspirant system which includes a water-based antiperspirant which feels comfortable on the skin and a capillary aerosol dispenser is disclosed. The antiperspirant system includes: a pressurized container (51) in which a water-based antiperspirant composition with one or more astringent active salts and a propellant are present, a valved outlet (41) on the surface of the container through which antiperspirant is ejected into an inlet port (111) of a capillary tube (11), a capillary tube (11) with one inlet port (111) and one exit port through which antiperspirant is dispensed from the system, and a coupling means (12) to closely couple the inlet port of the capillary tube (11) to the valved outlet (41) of the pressurized container (51). The void volume between the inlet port and the valved outlet is minimized, such that upon use of the antiperspirant system, the valved outlet, the capillary tube, and the void volume do not become obstructed by solid deposits of the astringent active salt.

13 Claims, 6 Drawing Sheets

(51) Int. Cl.

| | |
|---|---|
| ***F23D 11/38*** | (2006.01) |
| ***F23D 14/48*** | (2006.01) |
| ***A45D 34/00*** | (2006.01) |
| ***B65D 83/20*** | (2006.01) |

(58) Field of Classification Search
CPC ..... B05B 9/01; B05B 12/002; B65D 83/16; B65D 83/20; B65D 83/201; B65D 83/205; B65D 83/206; B65D 83/40
USPC ..... 239/589, 526; 222/402.13
See application file for complete search history.

(56) References Cited

U.S. PATENT DOCUMENTS

| | | | | |
|---|---|---|---|---|
| 4,680,173 | A * | 7/1987 | Burger | 424/47 |
| 4,695,451 | A * | 9/1987 | Straw | A61K 8/046 424/47 |
| 4,935,224 | A * | 6/1990 | Russo et al. | 424/47 |
| 2003/0150885 | A1 | 8/2003 | Dunne | |
| 2004/0101503 | A1* | 5/2004 | Mahe et al. | 424/70.14 |
| 2005/0053632 | A1* | 3/2005 | Schafer et al. | 424/401 |
| 2005/0103892 | A1* | 5/2005 | Rohrschneider et al. | 239/337 |

* cited by examiner

WATER-BASED ANTIPERSPIRANT AND AEROSOL DISPENSER THEREFOR

CROSS-REFERENCE TO RELATED APPLICATIONS

This application is the U.S. National Phase under 35 U.S.C. § 371 of International Application PCT/EP2005/006467, filed Jun. 16, 2005.

FIELD OF THE INVENTION

The present invention relates to aerosol antiperspirant systems, in particular to such systems comprising a water-based antiperspirant composition together with a suitable dispenser for aerosolization of the composition.

BACKGROUND TO THE INVENTION

Typical antiperspirant compositions for use in atomizing aerosols are based on astringent active salts suspended in silicone, silicone oil, or organic oil. In order to achieve satisfactory atomization thereof, comparatively large volumes of propellant, dilutant and/or solvent, in relation to the antiperspirant are necessary, both for providing sufficient pressure for the atomization process and for reducing the viscosity of the antiperspirant suspension. The propellant is conventionally a liquefiable propellant, such as short-chain aliphatic hydrocarbons (e.g., propane or butane) or short-chain ethers (e.g., dimethyl ether).

An effect of such typical antiperspirant compositions together with the propellant used therein is a spray which feels cold on the skin due to the low boiling point of the propellant and the effect of its rapid evaporation. The cooling has a less comfortable feeling upon the skin compared with liquids which evaporate less rapidly or have a higher boiling point. Another effect of such typical antiperspirant compositions is dryness and irritation/stinging of the skin. There is also a tendency for a white residue to be left on the skin, which can leave unwanted white marks on dark clothing.

An alternative to these typical antiperspirant compositions are water-based compositions, in which astringent salts are dissolved in an aqueous solution. Such water-based compositions may be water-in-oil emulsions. For example, WO 01/24766, WO 96/24326 and U.S. Pat. No. 4,695,451 disclosed particular water-in-oil emulsions for use as antiperspirant compositions. Such water-based compositions may also be single-phase compositions. For example, WO 96/18378 disclosed a single-phase antiperspirant composition having an astringent active salt dissolved in a polyol, wherein water was used as a polyol-solubilizing agent.

SUMMARY OF THE INVENTION

The inventors found that water-based compositions (including single-phase aqueous solutions and two-phase compositions, such as water-in-oil emulsions) may be better suited as antiperspirants. For example, they give a comfortable feel on the skin, they produce less irritation and cooling of the skin, they leave less white residue, they are better for the environment, and they can be formulated to moisturize the skin.

The inventors further found that conventional aerosol dispensers do not work well with water-based antiperspirant compositions. They do not satisfactorily atomize the liquid and, furthermore, the antiperspirant agent, in particular astringent active salts, tend to dry out and form deposits within the nozzle and valve assembly, leading to obstruction, blockage or impaired performance.

An object of the present invention is therefore to provide an aerosol antiperspirant system comprising a water-based antiperspirant composition and a propellant in an appropriate dispenser, said system being adapted to overcome the problems associated with using water-based antiperspirant compositions in conventional aerosol dispensers.

WO 03/051522 discloses an apparatus for atomizing liquids by means of a capillary. The system achieves satisfactory atomization, even of viscous liquid compositions, while using a lower ratio of propellant to liquid composition, and a lower amount of dilutant than needed in conventional aerosol dispensers. WO 03/051522 demonstrates that the system is able to dispense water and certain aqueous solutions. However, WO 03/051522 does not suggest that the system would be capable of dispensing water-based antiperspirant compositions, more specifically such compositions comprising astringent active salts. In particular, WO 03/051522 does not suggest that in a capillary aerosol dispenser, the capillary or the valve would not become obstructed by drying out and deposition of astringent active salts, when used to dispense antiperspirant compositions comprising such salts.

The inventors have now surprisingly found that use of a capillary tube to dispense water-based antiperspirant compositions comprising astringent active salts reduces or eliminates obstruction and clogging of the nozzle and valve. Furthermore, the inventors have found that when the void volume (or "dead space") between the inlet port of the capillary tube and the valved outlet of the container is minimized, in other words, when the inlet port of the capillary tube is closely coupled to the valved outlet of the container, blockages normally associated with crystal formation or "drip back" (return of expelled antiperspirant back through the capillary towards the inlet) are reduced or eliminated.

This way, the present invention overcomes the problem of nozzle and valve clogging by the components of the antiperspirant composition, in particular by astringent active salts, said problem occurring when using conventional aerosol dispensers for dispensing water-based antiperspirant compositions.

Accordingly, in one aspect the present invention provides an antiperspirant system comprising:

- a pressurized container in which a water-based antiperspirant composition comprising one or more astringent active salt, and a propellant are present,
- a valved outlet on the surface of the container through which antiperspirant is ejected into an inlet port of a capillary tube,
- a capillary tube having one inlet port and one exit port through which antiperspirant is dispensed from the system, and
- a coupling means to closely couple the inlet port of the capillary tube to the valved outlet of the pressurized container, so that the void volume between the inlet port and the valved outlet is minimized, such that upon use of the antiperspirant system, the valved outlet, the capillary tube, and the void volume do not become obstructed by solid deposits of the astringent active salt.

Preferred embodiments of the present invention are described below and illustrated in Figures and Examples.

SHORT DESCRIPTION OF THE FIGURES

Figure 3A:
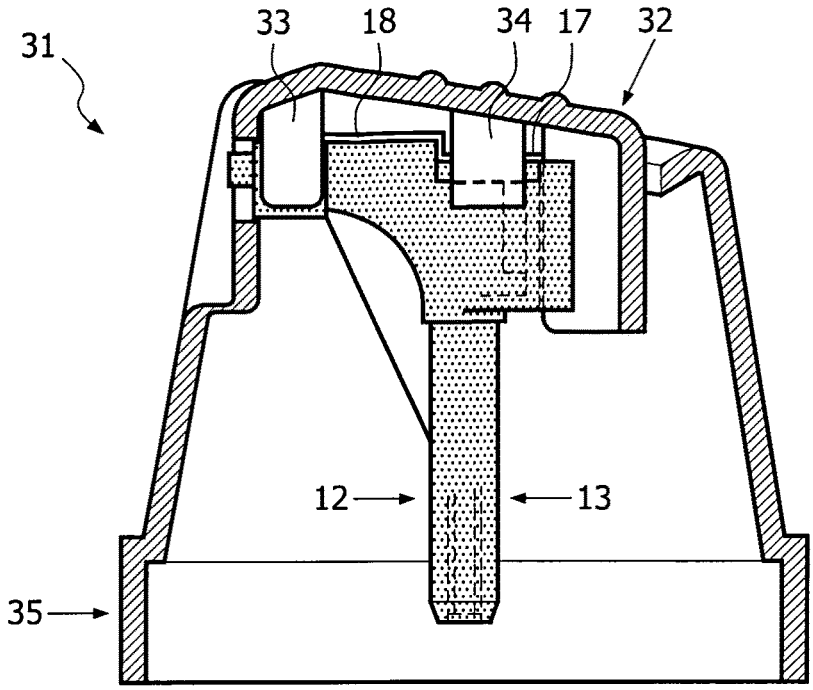
Figure 3B:
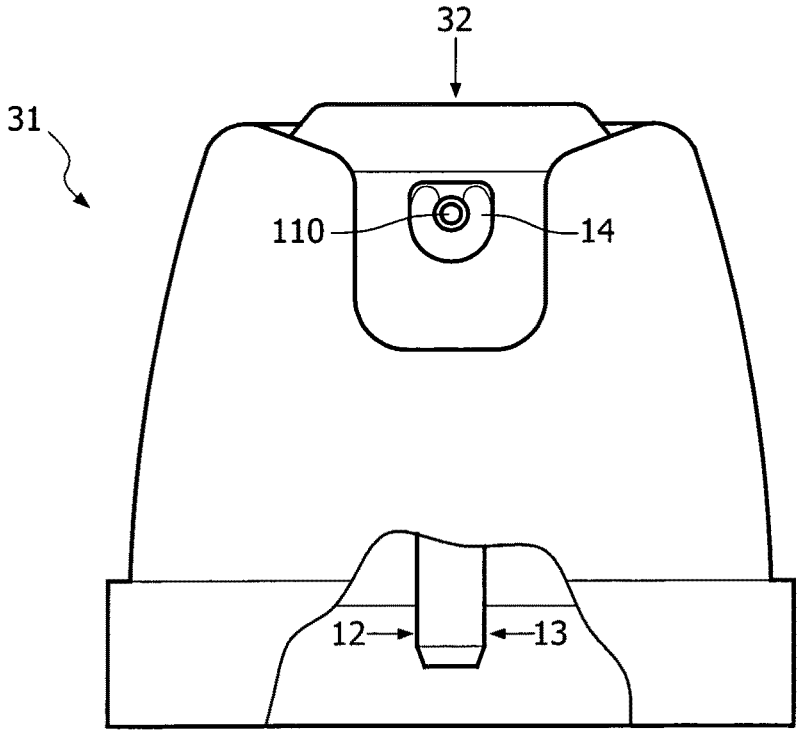

FIG. 3 illustrates the side view (FIG. 3*a*) and front view (FIG. 3*b*) of a cap and button assembly 31 of an antiperspirant system according to an embodiment of the present invention, with a coupling means 12 and a capillary tube 11 inserted.

Figure 4:
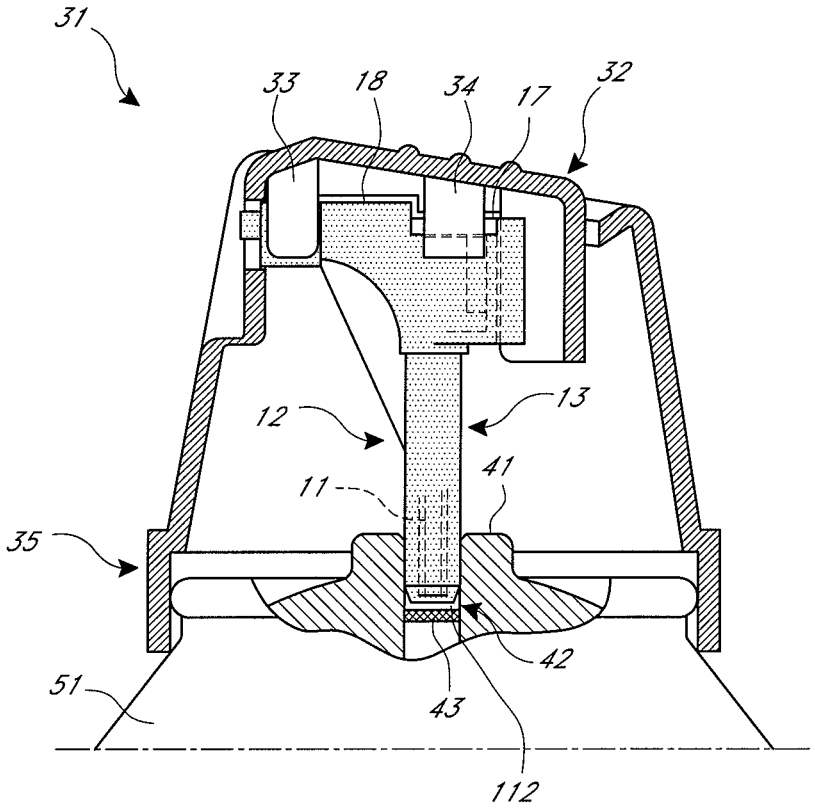

FIG. 4 illustrates the side view of a cap and button assembly 31 of an antiperspirant system according to an embodiment of the present invention, with a coupling means 12 and a capillary tube inserted and closely coupled to a valved outlet 41.

Figure 5:
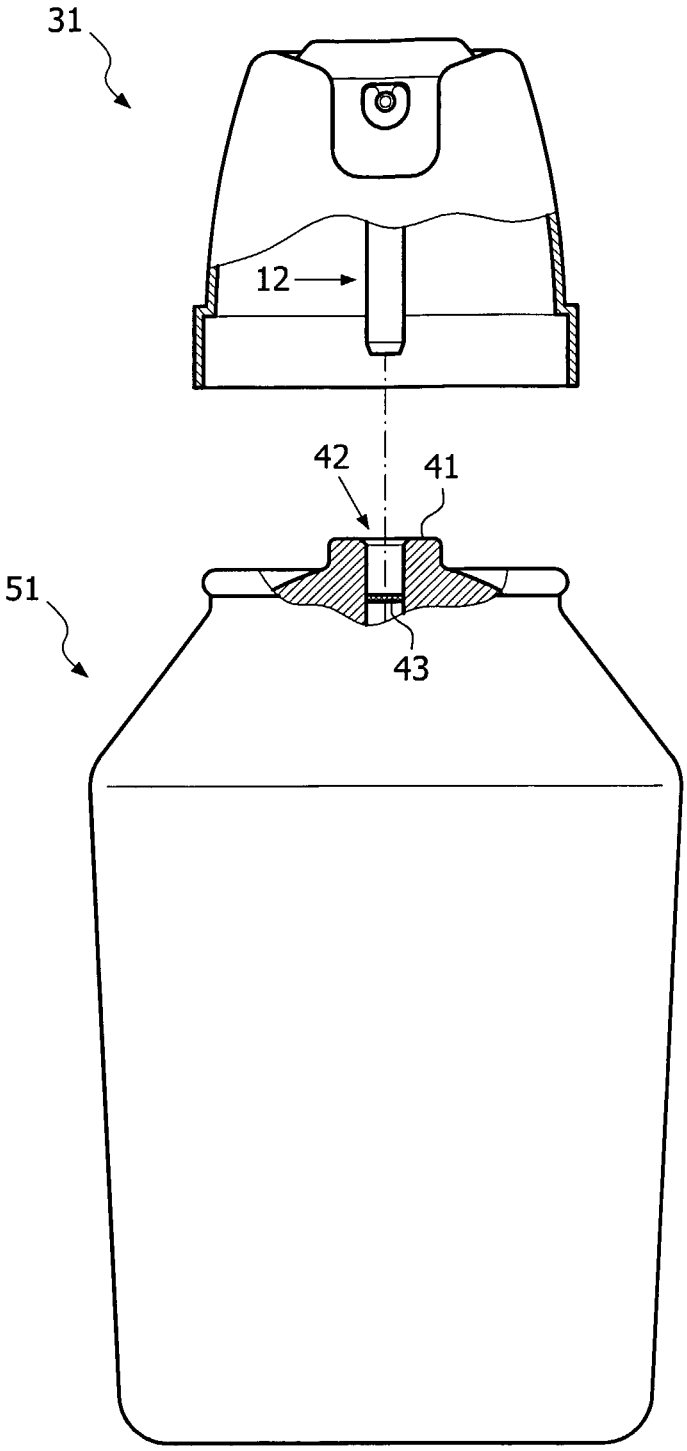

FIG. 5 illustrates an exploded front view of an antiperspirant dispenser of an antiperspirant system according to an embodiment of the present invention, comprising a cap and button assembly 31, with a coupling means 12 and a capillary tube 11 inserted, and an antiperspirant container 51 with a valved outlet 41.

Figure 6:
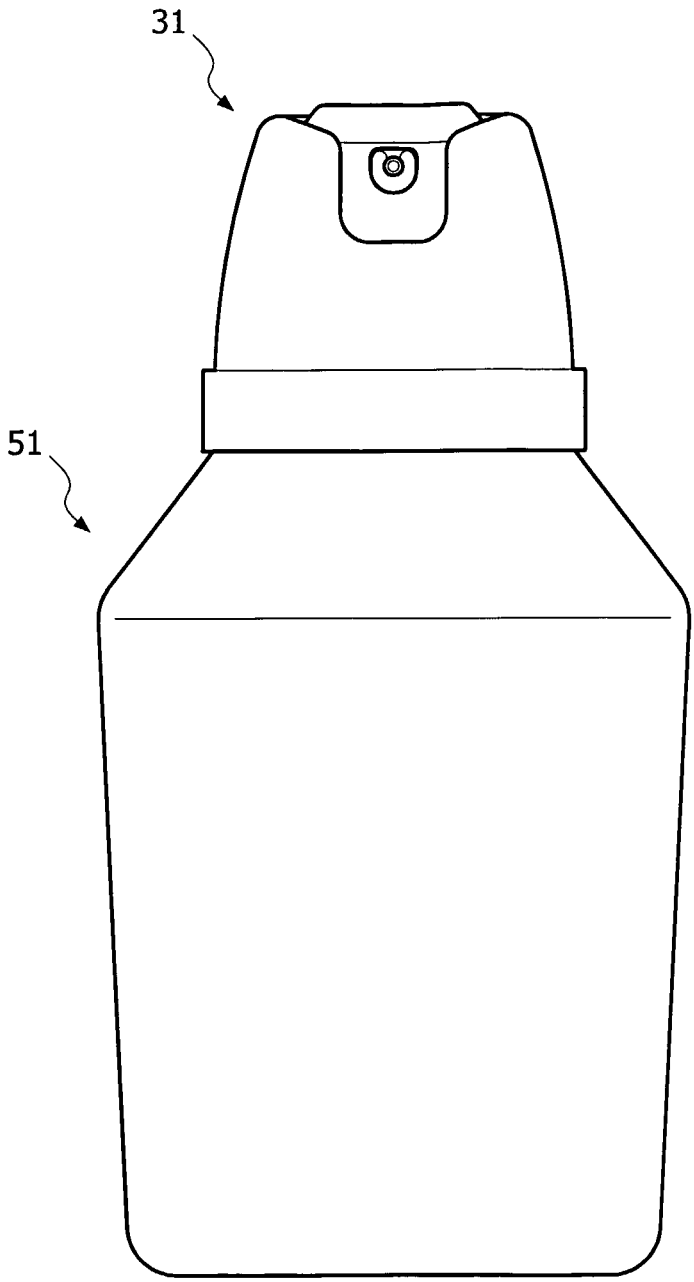

FIG. 6 illustrates the front view of an assembled antiperspirant dispenser of an antiperspirant system according to an embodiment of the present invention.

DETAILED DESCRIPTION OF THE INVENTION

The present invention discloses an antiperspirant system comprising a water-based antiperspirant composition and a dispenser, said antiperspirant system overcoming the problems of the art.

In one aspect the present invention provides an antiperspirant system comprising:

- a pressurized container in which a water-based antiperspirant composition comprising one or more astringent active salts, and a propellant are present,
- a valved outlet on the surface of the container through which antiperspirant is ejected into an inlet port of a capillary tube,
- a capillary tube having one inlet port and one exit port through which antiperspirant is dispensed from the system, and
- a coupling means to closely couple the inlet port of the capillary tube to the valved outlet of the pressurized container, so that the void volume between the inlet port and the valved outlet is minimized, such that upon use of the antiperspirant system, the valved outlet, the capillary tube, and the void volume do not become obstructed by solid deposits of the astringent active salt(s).

This aspect of the invention is further explained with help of FIGS. 1 through 6, which illustrate an embodiment of the present invention. The illustrated embodiment is exemplary and its features are in no way limiting to the scope of the invention.

A container of the present invention is a sealed vessel in which an antiperspirant composition and a propellant are present. It comprises a valved outlet 41 from which the antiperspirant composition is expelled, and a dip tube tubing which reaches down into the antiperspirant composition or into the admixture of the antiperspirant composition with the propellant, said dip tube being connected to the valved outlet. According to an embodiment of the invention, the wall of a container may be formed of metal, glass or plastic. Such containers are standard and known in the art. A useful example of a container according to the present invention is illustrated in FIGS. 5 and 6, showing the container 51 and the valved outlet 41.

According to an embodiment of the invention, a dip-tube consists of a continuous tubing which reaches down into an antiperspirant composition or an admixture of the antiperspirant composition with a propellant, and is connected to the valved outlet of the container.

According to an embodiment of the invention, an antiperspirant composition and a liquefied propellant may form a liquid admixture. The dip tube reaches down into the admixture and the components of the admixture are admitted into the dip tube through the same opening in the dip tube.

According to another embodiment of the invention, an antiperspirant composition may be located in a distinct compartment within the container and may be separated from a propellant by a physical barrier formed by the boundaries of such compartment. Such arrangement is exemplified by "bag-on-valve" systems known in the art. Here, an antiperspirant composition is contained in a bag which is connected to the valve housing. The bag is surrounded by a propellant which is typically a gaseous propellant. By exerting pressure on the bag, the propellant expels the bag contents through an opening in the valve housing when the valve is opened. The propellant may be admitted to the valve housing through a separate opening in the valve housing.

According to another embodiment of the invention, a gaseous (e.g., compressed air or nitrogen) propellant is located in the same compartment of the container as an antiperspirant composition, but is phase-separated from the liquid antiperspirant composition. Here, the dip tube or the valve housing has a lateral opening for admitting the propellant. The lateral opening is not immersed in the antiperspirant liquid when the container is in the position where it is actuated to dispense the antiperspirant.

According to an embodiment of the invention, the internal diameter of the dip tube may be 0.1 mm to 5 mm, 0.1 mm to 4 mm, 0.1 mm to 3 mm, 0.1 mm to 2 mm, 0.1 mm to 1 mm, preferably 0.2 mm to 1 mm.

A container comprises a valved outlet 41 which can be reversibly opened and closed. An example of a valved outlet 41 is shown in FIGS. 4 and 5. When the valved outlet is open, it allows the flow of the antiperspirant into an inlet port of a capillary tube 11. The valve may be opened, for example, by applying pressure thereto and closed by releasing the pressure—such arrangements are typical of known aerosol dispensers and therefore not illustrated in detail (see, e.g., WO 03/051522 for an exemplary arrangement). Alternatively, the valve may be opened using a different means, for example, by turning a tap, or activating a mechanism distant from the outlet valve. Generally, when the valve is closed, a physical barrier 43 completely blocks the passage of antiperspirant from the valved outlet to the capillary tube 11. In other words the valved outlet 41 is completely blocked across its cross-section by the physical barrier 43. Arrangements of valved outlets with suitable physical barriers are known in the art (see, e.g., WO 03/051522) and therefore not detailed herein; accordingly, the physical barrier 43 in FIGS. 4 and 5 is only a schematic representation illustrating its function, i.e., blocking the valved outlet 41 in the closed position.

The valved outlet may further comprise a receiving means for receiving a capillary tube, or for receiving a coupling means. The receiving means may take the form of a suitably shaped ridge, recess or cavity fashioned to receive and hold the coupling means or capillary tube. The receiving means may preferably be circular in shape. An example of a receiving means 42 is shown in FIG. 4.

An antiperspirant system of the present invention comprises at least one capillary tube. FIGS. 1 and 2 show an example of a capillary tube. The capillary 11 tube comprises an inlet port 111 for entry of the antiperspirant ejected from the valved outlet of the container, and an exit port 110 from which the antiperspirant is emitted from the system.

According to an embodiment of the invention, a capillary tube as applicable for the present invention may have an inner diameter of 0.1 mm to 2 mm, 0.1 mm to 1.5 mm, 0.1 mm to 1 mm, 0.1 mm to 0.8 mm, 0.2 mm to 2 mm, 0.2 mm to 1.5 mm, 0.2 mm to 1 mm, preferably 0.2 to 0.8 mm.

According to an embodiment of the invention, the inner diameter of the capillary tube is essentially constant along its length from the inlet port to the exit port. Its diameter may vary where there is a bend 19 in the capillary tube, such as, for example, to direct the expelled antiperspirant at an angle to the valved outlet. In an embodiment of the invention, the capillary tube comprises a bend such that the exit port of the capillary tube is essentially perpendicular to the inlet port.

The capillary of the present invention contains no flow restrictors, inserts or narrowings. The inventors have found that flow restrictors can present surfaces onto which the antiperspirant expelled from the container during application, can collect and subsequently dry, so leading to clogging or blockage.

With regard to the length of the capillary tube, it may cover a range from 5 mm to 100 mm, 5 mm to 90 mm, 5 mm to 80 mm, 5 mm to 70 mm, 5 mm to 60 mm, 5 mm to 50 mm, 5 mm to 40 mm, 5 mm to 30 mm, 5 mm to 20 mm, 5 mm to 10 mm, 10 mm to 100 mm, 10 mm to 90 mm, 10 mm to 80 mm, 10 mm to 70 mm, 10 mm to 60 mm, 10 mm to 50 mm, 10 mm to 40 mm, 10 mm to 30 mm, 10 mm to 20 mm, 20 mm to 100 mm, 20 mm to 90 mm, 20 mm to 80 mm, 20 mm to 70 mm, 20 mm to 60 mm, 20 mm to 50 mm, 20 mm to 40 mm, 20 mm to 30 mm, 30 mm to 100 mm, 30 mm to 90 mm, 30 mm to 80 mm, 30 mm to 70 mm, 30 mm to 60 mm, 30 mm to 50 mm, 30 mm to 40 mm, 40 mm to 100 mm, 40 mm to 90 mm, 40 mm to 80 mm, 40 mm to 70 mm, 40 mm to 60 mm, 40 mm to 50 mm, 50 mm to 100 mm, 50 mm to 90 mm, 50 mm to 80 mm, 50 mm to 70 mm, 50 mm to 60 mm, 60 mm to 100 mm, 60 mm to 90 mm, 60 mm to 80 mm, 60 mm to 70 mm, 70 mm to 100 mm, 70 mm to 90 mm, 70 mm to 80 mm, 80 mm to 100 mm, 80 mm to 90 mm, 90 mm to 100 mm, preferably 5 mm to 50 mm.

According to an aspect of the invention, the diameter of the capillary inlet port is designed such that at normal atmospheric pressure a volumetric flow ratio of 1:50 to 1:5000, preferably of 1:50 to 1:2500, of the antiperspirant liquid to propellant is obtained.

According to the present invention, the inlet port of the capillary tube is closely coupled to the valved outlet such that the void volume between the valved outlet and the inlet port of the capillary tube is minimized. In other words, the volume created between the physical barrier of the valved outlet, said physical barrier functioning to seal the container when the valve is closed, and the inlet port of the capillary tube is reduced to a minimum.

The void volume is preferably less than 20 $mm^3$, more preferably less than 10 $mm^3$, and most preferably less than 5 $mm^3$, i.e., 4, 3, 2, 1, or less than 1 $mm^3$.

According to the present invention, the antiperspirant system is disposed with a coupling means which facilitates the close coupling of the capillary tube to the valved outlet, so minimizing the void volume between the valved outlet and the inlet port of the capillary tube. The means may be, for example, a support which permits the inlet port of the capillary tube to touch the physical barrier of the valve. The means may be any according to the art. An example of a coupling means 12 is shown in FIGS. 1 through 5.

The inventors have found that when at least part of the coupling means is a tube 13 of which the internal diameter is suitable for receiving at least part of the capillary tube towards the inlet port, and of which the outer diameter is suitable for coupling with valved outlet or the receiving means thereon, the void volume is reduced and hence performance is improved (i.e., reduced clogging and optimized flow rate and droplets). Preferably, the inner diameter of the tube allows a close-fitting association with the capillary tube. Preferably, the outer diameter of the tube facilitates a close-fitting association with the valved outlet or the receiving means thereon.

Accordingly, in an embodiment of the invention, at least part of the coupling means is a tube

- the inner diameter of which matches or is slightly larger than the outer diameter of the capillary tube, and
- the outer diameter of which matches or is slightly smaller than the inner diameter of the valved outlet, the diameters permitting close coupling between the capillary tube, coupling means and valved outlet.

Figure 1A:
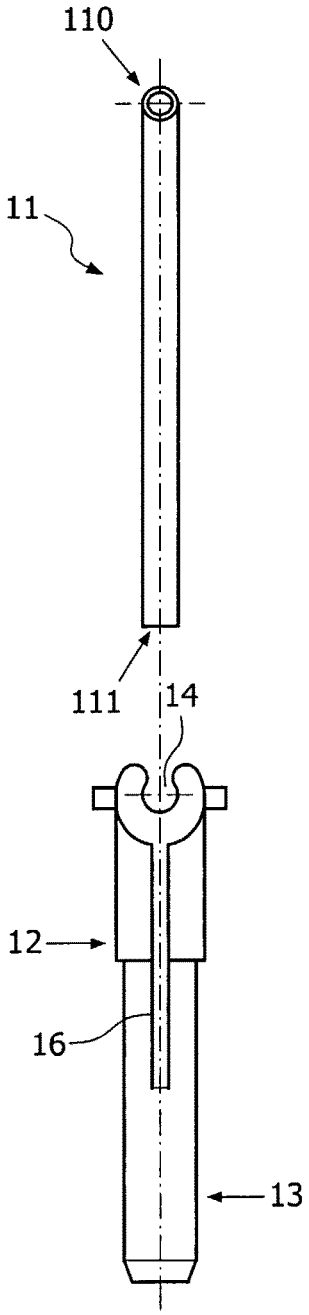
FIG. 1 illustrates a capillary tube 11 and a coupling means 12 according to an embodiment of the present invention in front view, i.e., dispensing towards the viewer (FIG. 1*a*), side view (FIG. 1*b*), rear view (FIG. 1*c*) and plan view (FIG. 1*d*).
Figure 1B:
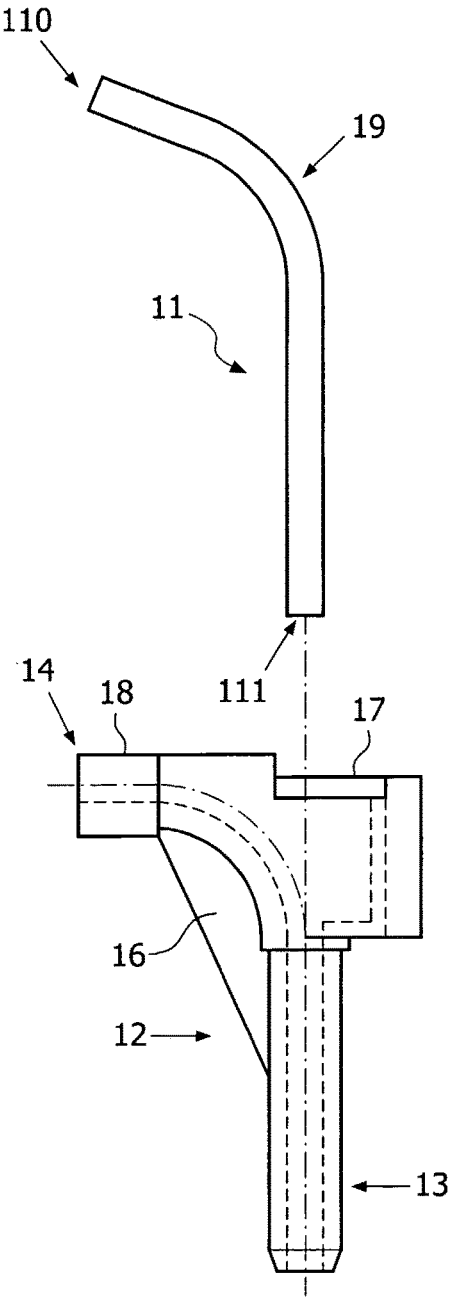
Figure 1C:
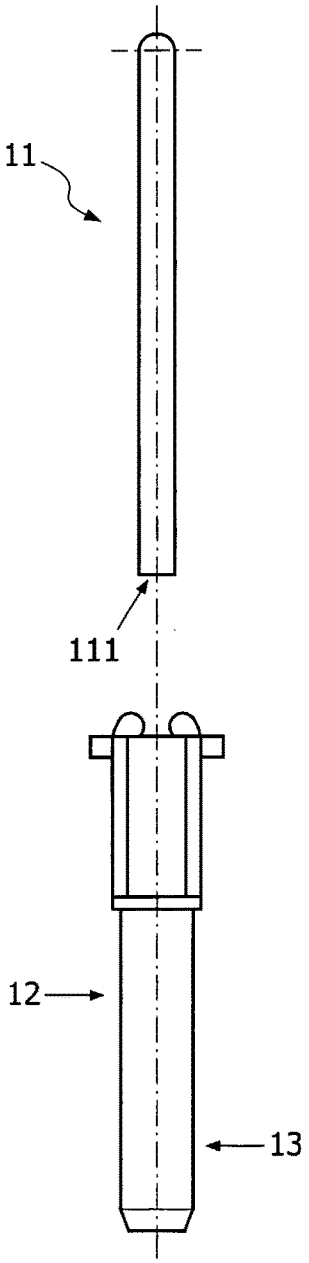
Figure 1D:
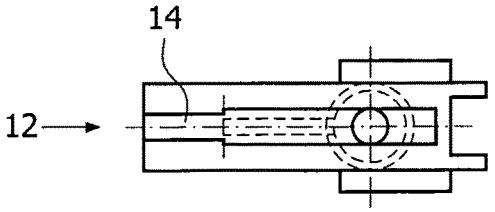
Figure 2A:
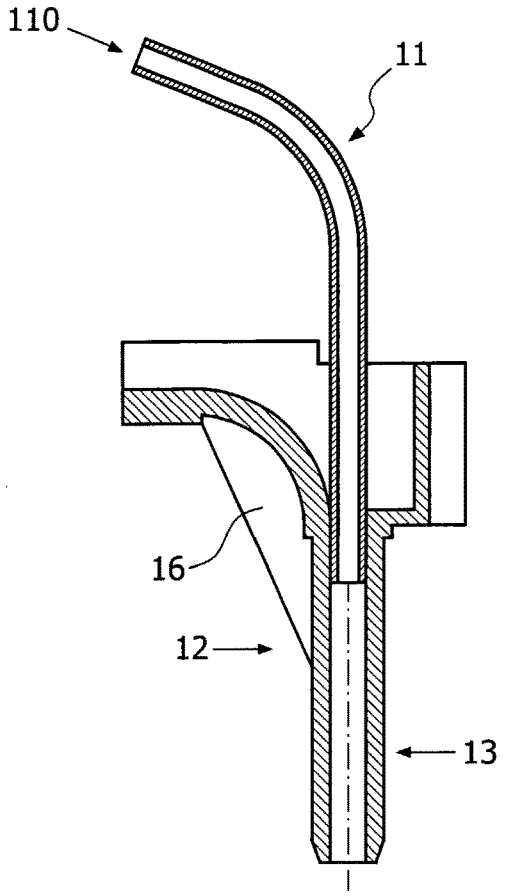
FIG. 2 illustrates the side view of partial insertion (FIG. 2*a*) and full insertion (FIG. 2*b*) and the front view of full insertion (FIG. 2*c*) of a capillary tube 11 into a coupling means 12 according to an embodiment of the present invention.
Figure 2B:
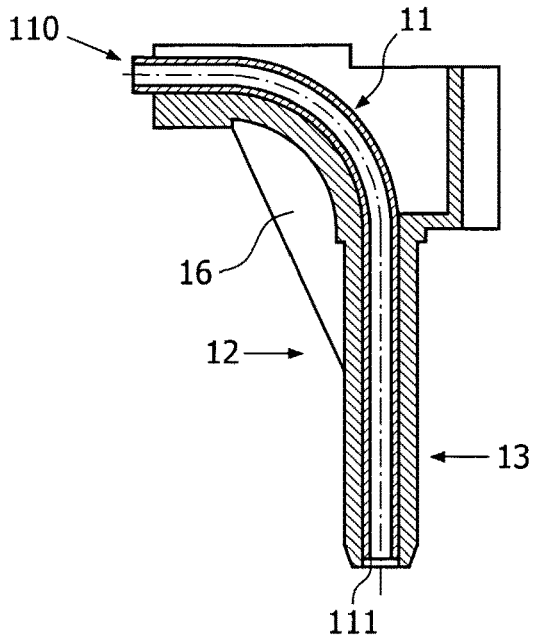

A useful example of this embodiment is illustrated in FIG. 2. In FIG. 2*a*, a capillary tube 11 is partially inserted towards its inlet port 111 into the tube 13 of a coupling means 12. In FIG. 2*b*, the capillary tube is fully inserted into the tube of the coupling means. In its fully inserted position, the inlet port 111 of the capillary tube essentially aligns with an opening at an end of the tube of the coupling means, which can closely associate with the valved outlet of the container or the receiving means thereon. The close association between the outer wall of the capillary tube and the inner wall of the tube of the coupling means should be noted.

Furthermore, the coupling means may support a bend in the capillary tube to direct the flow of antiperspirant from the container in a particular direction. In an embodiment the coupling means comprises a clip which is capable of gripping the capillary tube and further bending it.

Figure 2C:
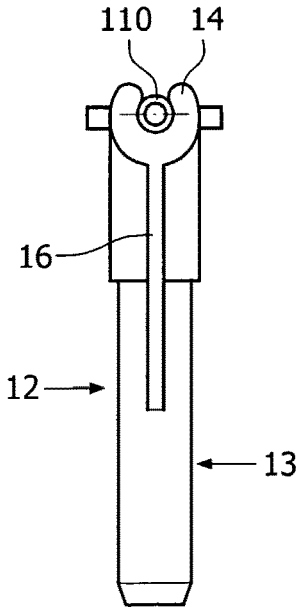

A useful example of this embodiment is illustrated in FIGS. 2*c* and 3*b*, in which the exit port end 110 of a capillary tube 11 is gripped by a coupling means 12 by way of a clip 14.

The coupling means may further provide a means for transmitting a physical force to the valve in order to open it, for example, by an action of depressing the collar. Such transmitting means may be, for example, a ridge, supporting struts, finger recess, or a means to transmit force from an antiperspirant cap.

In an embodiment, the coupling means comprises contact points which make contact with a button of a cap and button assembly of the antiperspirant system. Physical force applied to the button (e.g., by depressing the button) is so transmitted via the coupling means to the valve in order to open it. In order to withstand the physical force, the coupling means may be strengthened by means 16 of, e.g., a strut.

A useful example of this embodiment is illustrated in FIGS. 3*a* and 3*b*. In this example, the antiperspirant system comprises a cap and button assembly 31 in which a coupling means 12 with a capillary tube 11 is inserted. The button 32 of the assembly makes contact with the coupling means by way of a series of protrusions 33, 34 on the cap which co-operatively connect with contact points 17, 18 on the coupling means.

An exemplary embodiment of the present invention, illustrating close coupling of the different elements of the antiperspirant system, is shown in FIG. 4. Here, a coupling means 12 with a capillary tube 11 are inserted into a cap and button assembly 31, by co-operative connecting between a series of protrusions 33, 34 on the cap and contact points 17, 18 on the coupling means. The tube 13 of the coupling means—with the capillary tube inserted—is inserted into a valved outlet 41, more specifically into a receiving means 42 thereon which serves to receive the coupling means. A base 35 of the cap and button assembly is capable of attaching to an antiperspirant container 51 by way of reciprocating a coupling. Depressing a button 32 transmits physical force to the valved outlet via the coupling means, so opening the valve and causing antiperspirant to be expelled via the capillary tube. The Figure shows the close coupling between the valved outlet 41, the tube of the coupling means 13 and the capillary tube 11, resulting in minimizing of the void volume 112 between the valved outlet (or the physical barrier 43 thereof) and the inlet port 111 of the capillary tube. By closely coupling the above components and reducing the void volume, the inventors have found that the problems of drip back, blockage and impaired performance due to deposits of antiperspirant within the capillary, valve, or within dead spaces are reduced or eliminated.

According to the present invention, there are two main types of propellants. Those which liquefy under pressure, and those which do not. Both kinds are well known in the art.

Liquefiable propellants are typically organic, non-toxic and non-reactive with the other components of the antiperspirant composition. Suitable propellants include the C3-C4 aliphatic hydrocarbons, short-chain ethers (e.g., dimethyl ether), the chlorofluoro hydrocarbons containing 1-4 carbon atoms. Examples of the aliphatic hydrocarbons are liquefied propane, n-butane and isobutane. Examples of the chlorofluoro hydrocarbons are dichlorodifluoromethane, monochlorodifluoromethane, difluoromonochloroethane, trichlorotrifluoroethane, monofluorodichloromethane, monofluorodichloroethane, pentafluoromonochloroethane; cyclic hexafluorodichlorobutane, octafluoropropane, and cyclic octafluorobutane; and mixtures thereof. For environmental reasons, the preferred propellants are the C3-C4 hydrocarbons, with mixtures of isobutane and propane being particularly preferred.

With regard to non-liquefiable propellants, compressed carbon dioxide, compressed air or nitrogen may be used.

The flow rate at the exit port is mainly a function of the inner diameter of capillary tube and the type of propellant. For example, a smaller inner diameter of the capillary tube will result in a lower flow rate at the same pressure for propellant and liquid product. The particle size is also influenced by the volumetric ratio of liquid product to propellant. The lower the ratio of liquid product to propellant, the smaller the particles will be at the exit port.

Thus, if the particles produced at the exit port are too large in diameter, the ratio of liquid product to gas may be decreased.

In order to decrease the flow rate, the inner diameter of the capillary tube may be decreased, or, alternatively, the ratio of liquid product to propellant may be decreased.

In other words, if the particle size is acceptable, but the flow rate too high at the exit port, the latter can be regulated by decreasing the inner diameter of the capillary tube. Alternatively, an acceptable particle size initially combined with a low flow rate can be remedied by increasing the inner diameter, i.e. cross-section of the capillary tube.

In case the flow rate at the exit port is acceptable but the droplets produced are too large in diameter, the ratio of liquid product to propellant may be decreased and the inner diameter of the capillary tube increased. Alternatively, if the particles produced at the exit port are too small but the flow rate is acceptable, the ratio of liquid product to propellant may be increased and the inner diameter of the capillary tube may be decreased.

The apparatus according to the invention may be suitable for the atomization of liquid products having a dynamic viscosity from 0.3 mPa·s to 0000 mPa·s.

According to an embodiment of the invention, the flow rate of the antiperspirant from the exit port of the capillary may be 0.1 to 1.5 g/s, 0.1 to 1.2 g/s, 0.1 to 1.0 g/s, 0.1 to 0.8 g/s, 0.1 to 0.6 g/s, 0.2 to 1.5 g/s, 0.2 to 1.2 g/s, 0.2 to 1.0 g/s, 0.2 to 0.8 g/s, preferably 0.2 to 0.6 g/s.

According to another embodiment of the invention, the average diameter droplet size of the antiperspirant emitted from the exit port of the capillary tube may be 1 to 50 nm, more preferably 5 to 40 nm, and most preferably 10 to 30 nm.

An antiperspirant composition (or "base") according to the present invention is water-based. Water-based means that water is a major component of the antiperspirant base. The water-based antiperspirant according to the present invention may be a single-phase aqueous solution or may be a two-phase composition comprising an aqueous phase and an oil (lipophilic) phase. The water may be present in an amount of 5 to 90% by weight (w/w) of the base and preferably 25 to 75% by weight (w/w) of the base for a two-phase base and 5 to 50% by weight (w/w) of the base for a single-phase base. According to an aspect of the invention, water may be used to make a base up to 100% in which case the proportion of water depends on the proportions of the other components. The water acts as a solvent for the antiperspirant agents and other water soluble components.

An antiperspirant composition of the present invention comprises one or more water-soluble astringent active salts which have antiperspirant activity.

Astringent active salts (or "astringent salts") for use herein may include in particular aluminum, zirconium and mixed aluminum/zirconium salts, including both inorganic salts, salts with organic anions and complexes. Preferred astringent salts include aluminum, zirconium and aluminum/zirconium halides and halohydrate salts, such as chlorohydrates.

Astringent active salts include, but are not limited to, aluminum chlorohydrate, aluminum dichlorohydrate, aluminum sesquichlorohydrate, aluminum chlorohydrex propylene glycol complex, aluminum dichlorohydrex propylene glycol complex, aluminum sesquichlorohydrex propylene glycol complex, aluminum chlorohydrex polyethylene glycol complex, aluminum dichlorohydrex polyethylene glycol complex, aluminum sesquichlorohydrex polyethylene glycol complex, aluminum zirconium trichlorohydrate, aluminum zirconium tetrachlorohydrate, aluminum zirconium pentachlorohydrate, aluminum zirconium octachlorohydrate, aluminum zirconium trichlorohydrex glycine complex, aluminum zirconium tetrachlorohydrex glycine complex, aluminum zirconium pentachlorohydrex glycine complex, aluminum zirconium octachlorohydrex glycine complex, aluminum chloride or buffered aluminum sulfate.

Aluminum halohydrates are usually defined by the general formula $Al_2(OH)_xQ_y$ or a hydrate thereof in which Q represents chlorine, bromine or iodine, x is variable from 2 to 5 and x+y=6. The level of hydration is variable for example wherein there are up to about 6 or higher water molecules.

Zirconium compounds can usually be represented by the empirical general formula: $ZrO(OH)_{2n-nz}B_z$ or a hydrate thereof in which z is a variable in the range of from 0.9 to 2.0 so that the value 2n-nz is zero or positive, n is the valence of B, and B is selected from the group consisting of chloride, other halide, sulphamate, sulfate and mixtures thereof.

Possible hydration to a variable extent is represented by $wH_2O$, wherein w stands for the number of molecules of water of hydration. It is preferable that B represents chloride and the variable z lies in the range from 1.5 to 1.87. In practice, such zirconium salts are usually not employed by themselves, but as a component of a combined aluminum and zirconium-based antiperspirant. The level of hydration is variable for example wherein there are up to about 6 or higher water molecules.

The above aluminum and zirconium salts may have coordinated and/or bound water in various quantities and/or may be present as polymeric species, mixtures or complexes.

In particular, zirconium hydroxy salts often represent a range of salts having various amounts of the hydroxy group. Zirconium aluminum chlorohydrate may be particularly preferred.

Antiperspirant complexes based on the above-mentioned astringent aluminum and/or zirconium salts can be employed.

The complex often employs a compound with a carboxylate group, and advantageously this is an amino acid. Examples of suitable amino acids include dl-tryptophan, dl-beta-phenylalanine, dl-valine, dl-methionine and beta-alanine, and preferably glycine, which has the formula $CH_2(NH_2)$ COOH.

Complexes of a combination of aluminum halohydrates and zirconium chlorohydrates with or without with amino acids such as glycine can be employed in this invention. Certain of those Al/Zr-glycine complexes are commonly called ZAG in the literature. Aluminum-Zirconium actives or ZAG actives generally contain aluminum, zirconium and chloride with an Al/Zr ratio in a range from 2 to 10, especially 2 to 6, an Al/Cl ratio from 2.1 to 0.9. ZAG actives also contain a variable amount of glycine. In certain conditions, salts with an Al/Zr ratio greater than 2 (also known as low zirconium actives) may be preferred. Actives of these preferred types are available from Westwood, from Summit and from Reheis.

Other antiperspirant-salt actives that may be utilized include astringent titanium salts, for example those describe in GB 2299506A.

The proportion of solid astringent salt in a composition normally includes the weight of any water of hydration and any complexing agent that may also be present in the solid active. However, when the salt is in solution, its weight excludes any water present. The proportion of astringent salt component by weight of the antiperspirant base may usually be between 1% and 50% by weight (w/w). For a single-phase aqueous base the proportion of astringent salt component by weight of the base may preferably be between 1 and 20% by weight (w/w). For a two-phase base the proportion of astringent salt component by weight of the base may preferably be between 15 and 40% by weight (w/w).

An antiperspirant base of the present invention may optionally comprise one or more water-soluble glycols. The proportion of the glycol(s) by weight of the base is usually 0.1% to 30%, and preferably 2.5% to 25% by weight (w/w). Glycols act as co-solvents, particularly in single-phase antiperspirant compositions. Glycols may further help to mask the white marks that may occur on skin or clothing due to application of the antiperspirant. Glycols may further give a pleasant feel of the antiperspirant on the skin.

An antiperspirant base of the present invention may optionally comprise one or more water-soluble alcohols. Examples of suitable alcohols include, but are not limited to ethanol, methanol, and isopropylalcohol (propan-2-ol). The proportion of the alcohol(s) by weight of the base is usually 0.1% to 90%, and preferably 50% to 80% by weight (w/w). Alcohols act as antibacterial agents thus helping to prevent body odor. Alcohols may further function as solubilisers. Alcohols may further ensure that on application the product dries quickly.

An antiperspirant base of the present invention may optionally comprise one or more water-soluble perfumes. The proportion of the perfume(s) by weight of the base is usually 1% to 10%, and preferably 1% to 5% by weight (w/w). Perfumes are typically complex mixtures of many components and are well-known in the art. The inclusion of a perfume in the antiperspirant composition may necessitate the inclusion of an additional ingredient to assist the solubilization of the perfume. The water-soluble perfume(s) for use in the antiperspirant system of the present invention will preferably be stable at acidic pH and in the presence of metal ions.

An antiperspirant base of the present invention may be a two-phase composition, comprising both an aqueous phase and an oil phase. The two-phase composition may be a water-in-oil composition, wherein an oil phase constitutes the continuous phase, such as a water-in-oil emulsion. The two-phase composition may also be an oil-in-water composition, wherein an aqueous phase constitutes the continuous phase, such as an oil-in-water emulsion. Various types of two-phase antiperspirant compositions are known in the art and may be used in the context of the present invention. The proportion of the oil phase by weight of the base may be, for example, 1 to 75%, 1 to 50%, and preferably 5 to 40% by weight (w/w). The oil phase usually comprises at least an emollient and optionally an emulsifier. The oil phase may also comprise other lipophilic additives, such as, for example, lipophilic fragrances.

A two-phase antiperspirant base according to the present invention usually comprises one or more emollients. Exemplary emollients are volatile silicone oils, non-volatile silicone oils, fatty acid and fatty alcohol esters, hydrocarbons, and mixtures thereof. Useful volatile silicone oils may be, for example, cyclic or linear polydimethylsiloxanes containing from about 3 to about 9, preferably from about 4 to about 5, silicon atoms. Non-volatile silicone oils useful as an emollient may include polyalkylsiloxanes, polyalklyarylsiloxanes, and polyethersiloxane copolymers. Non-polar fatty acid and fatty alcohol esters useful as emollients may include, for example, di-isopropyl adipate, isopropyl myristate, isopropyl palmitate, isopropyl isostearate, butyl myristate, butyl laurate, butyl iso-stearate, ethyl hexyl palmitate, isodecyl neopentanoate, C12-C15 alcohol benzoate, diethyl hexyl maleate, PPG 14 butyl ether and PPG-2 myristyl ether propionate. Hydrocarbons useful as emollients may include, for example, isohexadecane, isododecane and petrolatum. Exemplary C8-C12 alkanols useful as emollients may include octanol, decanol and dodecanol. Preferred emollients are isopropyl palmitate and isopropyl myristate. Usually, the proportion of emollient by weight of the base is in the range of 1% to 50%, preferably 10% to 30% by weight (w/w).

An emollient usually functions to restore the integrity of the epidermal barrier. It provides a desirable film having an emollient or lubricating effect on the skin. It may also function as a carrier material in the oil phase of the base, i.e., an emollient which is miscible with or soluble in a liquefied propellant may delay the separation of the base from the propellant to ensure that the admixture remains substantially homogeneous for a period of time after shaking of the container. This period of time should as a minimum cover the period of time required by the consumer between shaking of the product and completing product application. Ideally, complete separation of the base and the propellant should take at least several hours and more ideally one or more days.

A two-phase antiperspirant base according to the present invention may further comprise a water-in-oil emulsifier. Such emulsifiers are C12-C18 alkanoic acid esters of polyhydroxylic compounds such as glycol, glycerol and sorbitol. Examples of satisfactory emulsifiers are propylene glycol stearate, glyceryl monostearate, sorbitan monolaurate, sorbitan monooleate, polyglycerol oleate, sorbitan sesquioleate and mixtures of the foregoing. Preferred emulsifiers include alkyl dimethicone copolyols, wherein the alkyl group is preferably lauryl- or cetyl-, and the copolyol is preferably polyethyleneglycol (PEG) or polypropyleneglycol (PPG), or a mixture of PEG and PPG. These emulsifiers manifest low solubility in water and good solubility in non-polar solvents at room temperature. Usually, the proportion of emulsifier in the base will be in the range of 0.5% to 5%, preferably 0.75% to 4%, by weight (w/w) of base. The proportion is sufficient to provide a substantially stable water-in-oil emulsion before and after dilution with the propellant component.

A two-phase antiperspirant base of the present invention may further comprise one or more perfumes which are soluble in the oil phase. Usually, the proportion of the perfume(s) by weight of the base will be in the range of 0.5% to 5%, preferably 0.75% to 4% by weight (w/w).

An antiperspirant base of the present invention may optionally comprise one or more additional active components. These may include, but are not limited to, antibacterial or antimicrobial agents (e.g., triclosan (5-Chloro-2-(2, 4-dichlorophenoxy) phenol), odour-absorbing agents (e.g., zinc ricinoleate), coloring agents, and skin-care agents (e.g., vitamins). Such additional components and their appropriate proportions in the antiperspirant base are well-known in the art.

By way of example and not limitation, a two-phase antiperspirant composition (base) may thus comprise by weight:

1 to 3% (w/w) of emulsifier (e.g., polyglyceryl-3 diisostearate),
1 to 3% (w/w) of perfume (fragrance)
15 to 40% (w/w) of astringent active salt (e.g., aluminium chlorohydrate),
2 to 6% (w/w) of moisturizer/co-solvent (e.g., glycerin, polyglycols),
3 to 30% (w/w) of one or more emollient components (e.g., 1 to 10% isopropyl palmitate, 1 to 10% isododecane, 1 to 10% isohexadecane)

the remainder up to 100% being made up by water.

By way of example and not limitation, a single-phase antiperspirant composition (base) may thus comprise by weight:

1 to 3% (w/w) of perfume (fragrance),
5 to 40% (w/w) of polyglycol (e.g., dipropylene glycol),
40 to 70% (w/w) of alcohol,
2 to 10% (w/w) of astringent active salt (e.g., aluminium chlorohydrate), the remainder up to 100% being made up by water.

One exemplary embodiment of the above single-phase antiperspirant composition comprises:

2% (w/w) of perfume (fragrance),
26% (w/w) of dipropylene glycol,
64% (w/w) of ethanol,
5% (w/w) of aluminium chlorohydrate, the remainder up to 100% being made up by water.

The invention is further illustrated according to the following non-limiting examples.

Example 1: Antiperspirant System Comprising a Water-in-Oil Antiperspirant and a Capillary-Type Atomizer An antiperspirant base was formulated according to the following table, using the method below:

| Phase | INCI name | % (w/w) |
|---|---|---|
| A | polyglyceryl-3 diisostearate | 3.0 |
| A | Isopropyl palmitate | 9.00 |
| A | Isododecane | 9.00 |
| A | Perfume | 2.00 |
| A | Butylated hydroxy toluene (BHT) | 0.02 |
| B | Glycerin | 5.00 |
| B | Aluminum chlorohydrate | 25 |
| B | Water demineralized | Up to 100% |

Phase A was added to a main vessel (cold). Phase B was added to a premix vessel (cold). Phase B was added under stirring to the main vessel, after which the mixture was stirred for another 20 minutes. In an emulsion step, the mixture was emulsified in order to achieve an average particle size of around 5 microns, while minimizing particle sizes of less than 1.

The antiperspirant base so obtained was packaged into an aerosol container, and isobutane/propane (80/20, w/w) added thereto as propellant. The proportion of antiperspirant base:propellant was 60:40 (w/w). Typical compositions of product are indicated in the table below:

| Product filling | Weight (g) | Volume (ml) |
|---|---|---|
| Antiperspirant base | 47.1 | 42.8 |
| Isobutane/propane (80/20) | 31.4 | 57.2 |
| Total | 78.5 | 100.0 |

A capillary of bore diameter 0.4 mm was inserted into a supporting collar (FIG. 1, 12) which acted to closely couple the capillary to the outlet valve, bend the capillary around 90 deg, and to transmit pressure from the cap to the valve in order to activate the valve.

Typical flow rates achieved were 0.3-0.5 g/s, and droplet sizes were in the range of 10 to 30 nm.

The inventors found the system dispensed antiperspirant with all the aforementioned advantages (e.g. no cooling effect, improved feel on the skin) and further offered good spraying quality with no blockages.

What is claimed is:

1. An antiperspirant system comprising:

a pressurized container comprising:

an antiperspirant composition in the form of an oil in water emulsion comprising:
one or more astringent active salts,
water,
an emulsifier, and
one or more materials selected from emollients, glycols, alcohols, perfumes, antibacterial agents, antimicrobial agents, zinc ricinoleate, coloring agents, skin-care agents, and vitamins;
a propellant,
a capillary tube having:
one inlet port, and
one exit port through which the antiperspirant composition is dispensed from the system,
a valved outlet on a surface of the pressurized container through which the antiperspirant composition is ejected into the inlet port of the capillary tube, and
a coupling means to closely couple the inlet port of the capillary tube to the valved outlet of the pressurized container, so that a void volume between the inlet port and the valved outlet is minimized,
such that upon use of the antiperspirant system, the valved outlet, the capillary tube, and the void volume do not become obstructed by solid deposits of the one or more astringent active salts.

2. The system according to claim 1, wherein the capillary tube comprises an essentially constant inner diameter between the inlet port and the exit port.

3. The system according to claim 1, wherein the inner diameter of the capillary tube is between 0.1 mm and 2.0 mm.

4. The system according to claim 1, wherein the inner diameter of the capillary tube is between 0.2 mm and 0.8 mm.

5. The system according to claim 1, wherein at least part of the coupling means comprises a tube of which internal diameter is suitable for receiving at least part of the capillary tube, and of which outer diameter is suitable for coupling with the valved outlet.

6. The system according to claim 1, wherein the void volume is less than 20 $mm^3$.

7. The system according to claim 1, wherein said astringent active salt is any selected from the group consisting of inorganic salts, salts with organic anions and complexes of aluminum, zirconium and mixed aluminum and zirconium.

8. The system according to claim 1, wherein said astringent active salt is any selected from the group consisting of aluminum chlorohydrate, aluminum dichlorohydrate, aluminum sesquichlorohydrate, aluminum chlorohydrex propylene glycol complex, aluminum dichlorohydrex propylene glycol complex, aluminum sesquichlorohydrex propylene glycol complex, aluminum chlorohydrex polyethylene glycol complex, aluminum dichlorohydrex polyethylene glycol complex, aluminum sesquichlorohydrex polyethylene glycol complex, aluminum zirconium trichlorohydrate, aluminum zirconium tetrachlorohydrate, aluminum zirconium pentachlorohydrate, aluminum zirconium octachlorohydrate, aluminum zirconium trichlorohydrex glycine complex, aluminum zirconium tetrachlorohydrex glycine complex, aluminum zirconium pentachlorohydrex glycine complex, aluminum zirconium octachlorohydrex glycine complex, aluminum chloride and buffered aluminum sulfate.

9. The system according to claim 1, wherein the antiperspirant composition comprises between 5% and 90% by weight (w/w) of water.

10. The system according to claim 1, wherein the antiperspirant composition comprises between 1% and 50% by weight (w/w) of the one or more astringent active salt.

11. The system according to claim 1, wherein the emollient is present.

12. The system according to claim 1, wherein said propellant is any of liquefied $C_3$-$C_4$ aliphatic hydrocarbons, propane, n-butane, isobutane and dimethyl ether.

13. The system according to claim 1, wherein the vitamin is present.

* * * * *